United States Patent [19]

Marino et al.

[11] Patent Number: 4,559,009

[45] Date of Patent: Dec. 17, 1985

[54] AGGREGATE DRYER BURNER

[75] Inventors: John A. Marino, Palmyra; Roderick G. Strohl, Jr., Annville; Robert B. Yost, Bethel, all of Pa.

[73] Assignee: Hauck Manufacturing Company, Lebanon, Pa.

[21] Appl. No.: 649,975

[22] Filed: Sep. 12, 1984

Related U.S. Application Data

[63] Continuation of Ser. No. 405,765, Aug. 6, 1982, abandoned, which is a continuation of Ser. No. 157,434, Jun. 9, 1980, abandoned.

[51] Int. Cl.[4] ..... F23M 9/00

[52] U.S. Cl. ..... 431/184; 431/186; 431/187; 431/284; 239/402.5; 239/404; 239/406

[58] Field of Search ..... 431/9, 183, 184, 187, 431/284, 265, 186; 239/400, 402.5, 404, 406, 424.5

[56] References Cited

U.S. PATENT DOCUMENTS

| | | | |
|---|---|---|---|
| 1,950,980 | 3/1934 | Frisch | 239/400 |
| 2,041,535 | 5/1936 | Frisch | 431/184 |
| 2,320,576 | 6/1943 | Dunn | 239/402 |
| 2,379,490 | 7/1945 | Kruger | 431/188 |
| 2,480,345 | 8/1949 | Watts | 431/265 |
| 2,531,538 | 11/1950 | Smith | 239/404 |
| 2,873,099 | 2/1959 | Wittke | 239/404 |
| 2,898,874 | 8/1959 | Crewdson, Jr. | 239/402.5 |
| 3,049,173 | 8/1962 | Costello et al. | 431/284 |
| 3,254,846 | 6/1966 | Schreter et al. | 239/400 |
| 3,336,965 | 8/1967 | McKinnon et al. | 431/185 |
| 3,349,826 | 10/1967 | Poole et al. | 431/183 |
| 3,391,981 | 7/1968 | Voorheis et al. | 431/185 |
| 3,468,487 | 9/1969 | Warren | 239/403 |
| 3,474,970 | 10/1969 | Simmons et al. | 239/404 |
| 3,676,060 | 7/1972 | Bedetti | 431/187 |
| 3,715,181 | 2/1973 | Zink et al. | 431/184 |
| 3,723,049 | 3/1973 | Juricek | 431/183 |
| 3,748,087 | 7/1973 | Shular | 431/182 |
| 3,758,259 | 9/1973 | Voorheis | 431/9 |
| 3,811,277 | 5/1974 | Markowski | 431/183 |
| 3,822,654 | 9/1974 | Ghelfi | 431/284 |
| 3,831,843 | 8/1974 | Masai | 239/8 |
| 3,844,484 | 10/1974 | Masai | 239/404 |
| 3,942,939 | 3/1976 | Matsumura et al. | 431/215 |
| 3,979,069 | 9/1976 | Garafalo | 239/400 |
| 4,095,929 | 6/1978 | McCartney | 431/188 |
| 4,111,369 | 9/1978 | Sharpe | 239/400 |
| 4,208,180 | 6/1980 | Nakayasu et al. | 431/284 |

OTHER PUBLICATIONS

*Combustion Aerodynamics*, J. M. Beer and N. A. Chigier, Halsted Press Div., John Wiley & Sons, Inc., 1972, Chap. 5, pp. 100–146.

Dr. I. W. Leuckel and N. Fricker, "The Characteristics of Swirl-Stabilized Natural Gas Flames", *J. Inst. Fuel*, Jun. 1976, pp. 103–112.

*Primary Examiner*—Margaret A. Focarino

*Attorney, Agent, or Firm*—Finnegan, Henderson, Farabow, Garrett & Dunner

[57] ABSTRACT

A swirl-type internal flame recirculation burner as used to fire asphalt plant aggregate dryers, air heaters and calcining kilns and method includes an atomizer assembly for swirling primary air in two concentric streams with the inner stream swirling more rapidly than the outer stream. Fuel oil is blast atomized in a continuous sheet into the inner stream without prefilming and then is shear atomized as the inner and outer streams violently intermix. The burning and swirling fuel and primary air mixture recirculates upstream along the burner axis. Secondary air is swirled in the same direction as the primary air and surrounds the primary air stream to promote further mixing and internal recirculation. A metal frustro-conical flame holder surrounds the burner head to stabilize and shape the recirculation flame and shield low-burn flames from tertiary air. The swirl of the secondary air is also adjusted to shape the flame. The burner may also be fired on gas or a combination of gas and oil.

20 Claims, 9 Drawing Figures

AGGREGATE DRYER BURNER

This application is a continuation of application Ser. No. 405,765, filed Aug. 6, 1982, and now abandoned, which is a continuation of Ser. No. 157,434, filed June 9, 1980, and now abandoned.

The invention relates to heating burners of the type used in asphalt plants to heat and dry aggregate prior to mixing with tar to form paving asphalt, to heat air or to heat calcining kilns.

U.S. Pat. No. 3,254,846, assigned to Hauck Manufacturing Co. of Lebanon, Pa., discloses a conventional heating burner of this type. The patent burner uses an external recirculating flame and must be fired within a large and heavy tile in order to stabilize the flame. The tile measures as much as 30 inches in diameter with the length of 30 inches and may weigh from 600 to 700 pounds. Periodically, tiles must be replaced, thereby requiring burner shutdown and increasing maintenance cost.

The burner of the present invention eliminates the need for a ceramic flame retention tile by use of a stable swirled internal recirculation flame. An adjustable frustro-conical metal flame holder surrounds the burner head and aids in shaping the flame at both high and low burns while also preventing unmodulated tertiary air from cooling and destabilizing the flame at low-burn. The degree of swirl imparted to secondary air is adjusted to aid in shaping the flame to fit the available combustion zone of a particular application. Thus, in some applications a long and relatively small-diameter stable flame is required where for other applications the flame must be shorter and bushier.

The burner atomizer assembly divides primary air into two approximately equal flows and accelerates and swirls in the inner primary air flow to impart a high degree of swirl. A continuous sheet of fuel oil is blast-atomized into this swirl and is immediately broken up into droplets entrained within the flow to prevent pre-filming on the opposite passage wall.

The highly swirling inner primary air stream, rich with oil particles, swirls out of the mouth of the inner primary air passage and against a less actively swirled outer primary air flow confined within the mouth of the primary air tube. Because the inner primary air is swirled more rapidly than the outer primary air and may travel axially slower than the outer primary air, there is strong shear atomization, a violent intermingling between the two primary air flows. This intermingling mixes the fuel particles in the two flows and further aids in breaking up the particles and evaporating the fuel.

At both high and low burns, the ignited swirling mixture of fuel and inner and outer primary air moves axially downstream and radially outwardly to decrease the axial pressure and promote upstream axial recirculation of burning and unburned gases alike. Recirculation further serves to mix and heat the unburned gases and fuel, thereby promoting efficient combustion, particularly when the burner is fired by heavy No. 5 or No. 6 fuel oil. At low-burn, the flow through the atomizer alone provides a stable recirculation flame on the burner head. In one burner according to the invention, the low-burn flame produces about 7 million btu per hour.

At high burn, primary air is supplied to the atomizer assembly as at low-burn and oil is flowed into the inner primary air passage at a higher rate than at low-burn. Combustion air is also flowed through the secondary air path of the burner. The path includes an adjustable spin-vane assembly so that the secondary air is spun in the same direction as the primary air and issues from the burner head in a concentric flow surrounding the swirling primary air. The secondary air is spun less actively than the primary air. This secondary air flow, in combination with the primary air flow, recirculates as part of an enlarged internal recirculation flame. Additionally, at high-burns, a larger volume of tertiary air is drawn past the flame holder and into the combustion zone. This air further mingles with the swirling internal recirculation flame to complete combustion of the fuel. At high-burns, a burner of the type disclosed may have output of about 68 million btu per hour. The output of the burner is continuously adjustable between high and low burns.

The secondary air swirl vane assembly includes a number of circumferentially spaced radial swirl vanes ganged to an adjustment ring surrounding the burner. The angular orientation of the vanes is adjusted simultaneously by rotating the ring relative to the burner. An improved linkage between the ring and vanes permits ready adjustment of the vanes to a proper position for imparting the desired swirl to the secondary air. The vanes are closely fitted within the radially inward extending step in the secondary air passage to assure efficient energy transfer during swirling.

In addition to being fueled by oil, the burner may be fueled by gas or a mixture of gas and oil. The gas flame is also of a swirled internal recirculation type, due to a limited flow of combustion air through the primary and secondary air passages. While the gas itself is not swirled, it mingles with the outwardly swirling primary and secondary air flows to create an internal swirling recirculation flame.

The drawings illustrate a burner according to the invention used in an asphalt plant to heat an aggregate dryer drum. In this application, both the burner and drum are mounted on a portable frame with the burner at one end of the frame. Elimination of the relatively large and heavy flame retention tile enables the burner to be positioned closer to the drying drum than heretofore possible. The combustion air is supplied to the burner by a conventional centrifugal blower. The burner includes a combustion air damper assembly located at 45° to the burner axis. This assembly provides for a smooth flow of the combustion air to the burner head with compact location of the centrifugal blower on the end of the frame immediately forward of the burner. The arrangement makes efficient use of space and represents a marked improvement over the conventional installation where the blowers need be mounted on the ground below the frame.

Other objects and features of the invention will become apparent as the description proceeds, especially when taken in conjunction with the accompanying drawings illustrating the invention, of which there are five sheets.

IN THE DRAWINGS

FIG. 1 is a side view, partially broken away, of an aggregate drying drum using a burner according to the invention;

Figure 5:
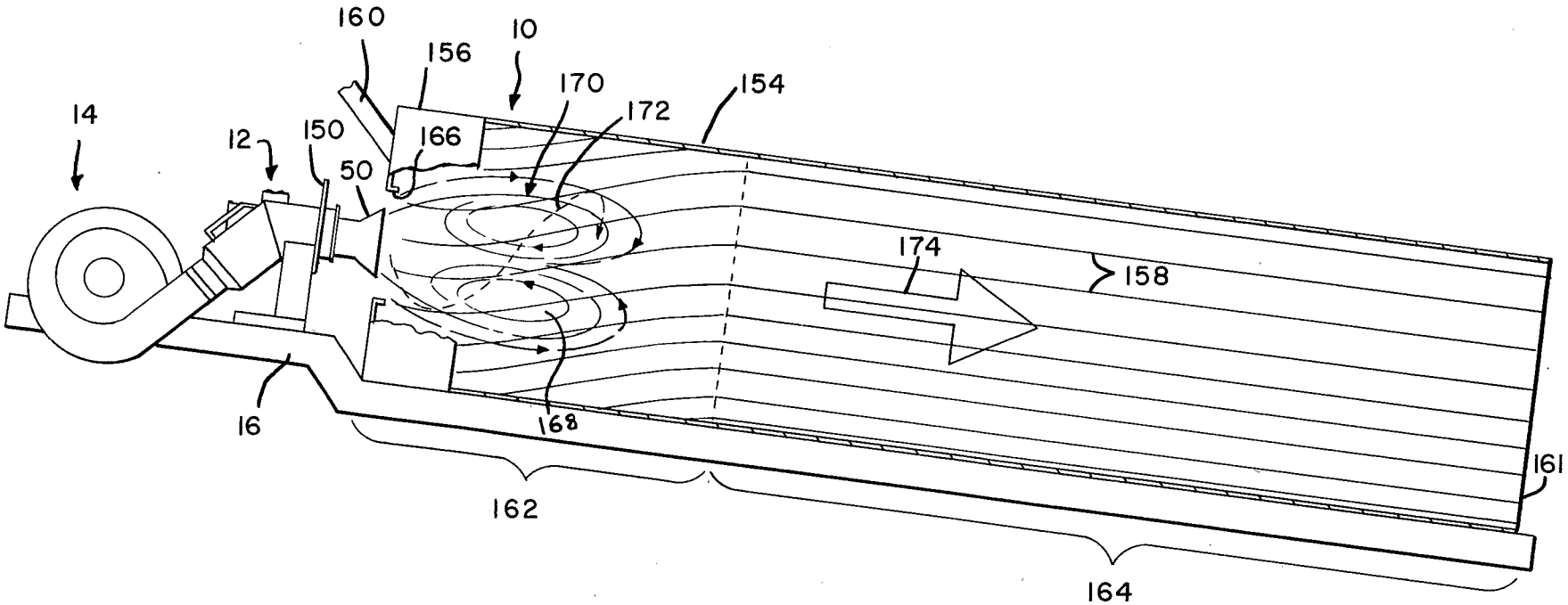
FIG. 5 is a view taken along line 5—5 of FIG. 2; with the flame holder removed.
Figure 7:
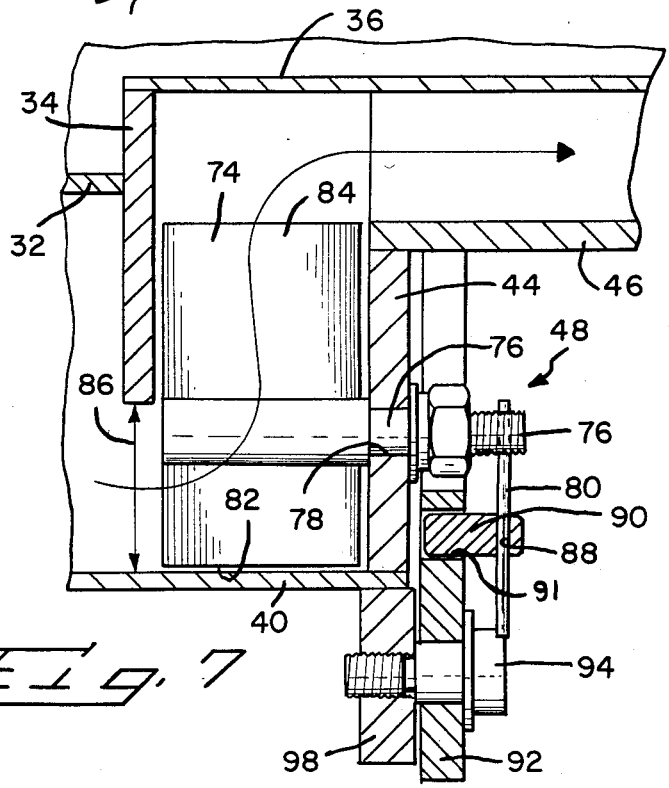
Figure 8:
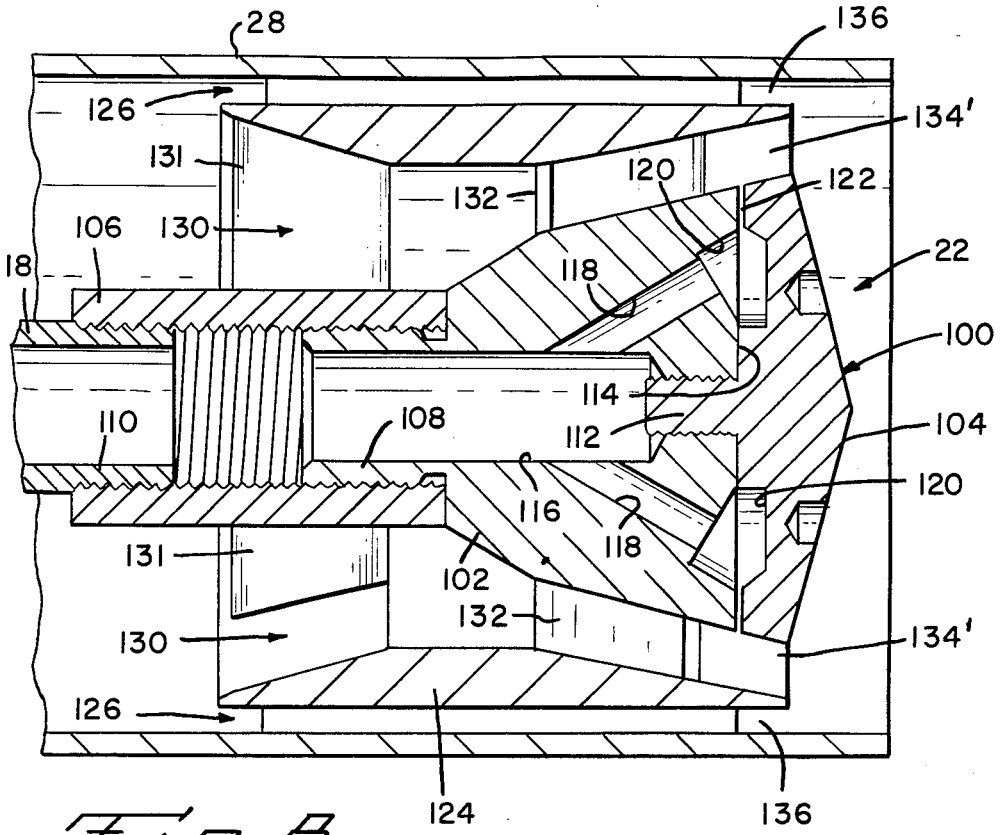
Figure 9:
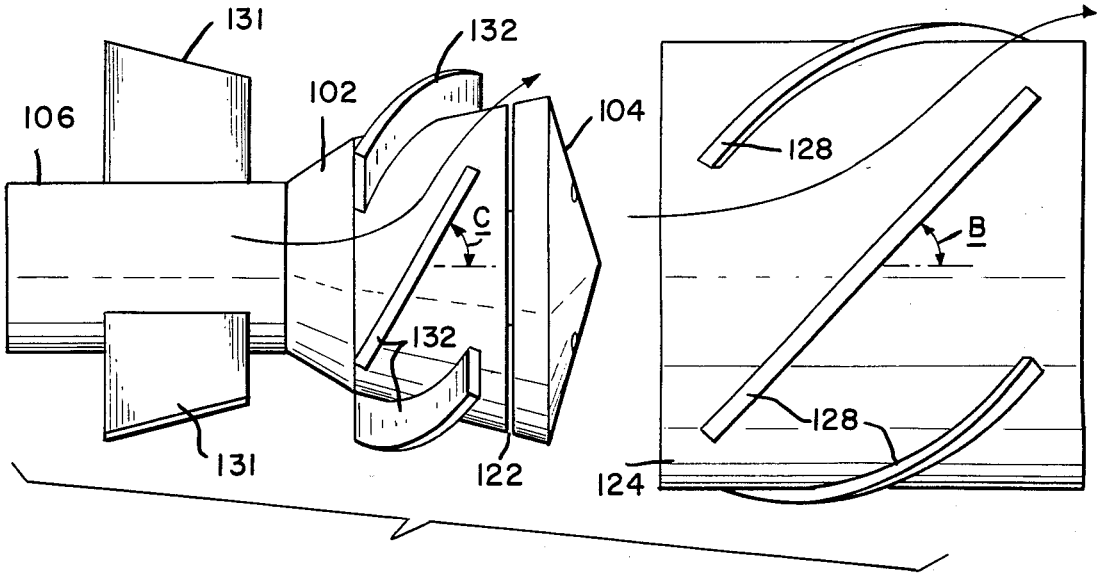

FIGS. 7 and 8 are sectional views taken generally along lines 7—7 and 8—8 of FIG. 5; and FIG. 9 is an exploded view of a part of the atomizer assembly shown in FIG. 7.

DESCRIPTION OF THE BURNER

FIG. 1 schematically illustrates a portable rotary aggregate dryer 10 of the type used to dry and preheat aggregate for mixing with a petroleum base material in the manufacture of paving asphalt. The dryer 10 is heated by burner 12 which includes a centrifugal blower 14 for supplying combustion air to the burner. The dryer, burner and blower are all mounted on a suitable frame 16.

Figure 2:
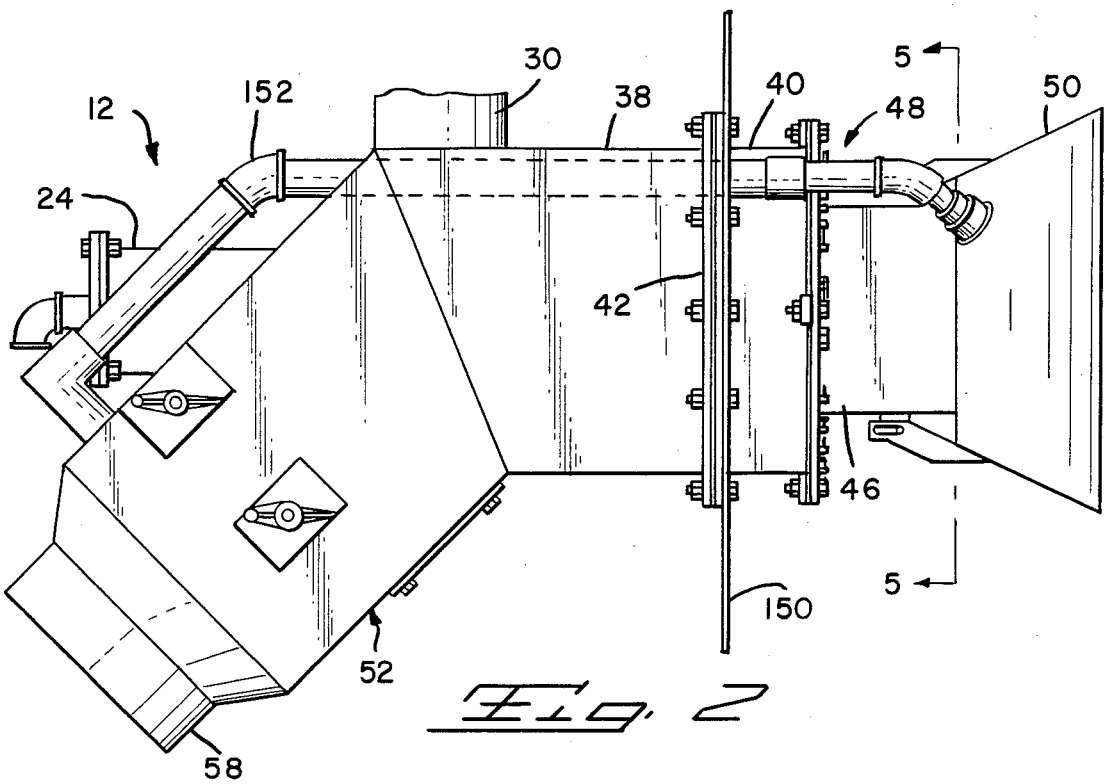
FIG. 2 is a side view of the burner of FIG. 1.
Figure 4:
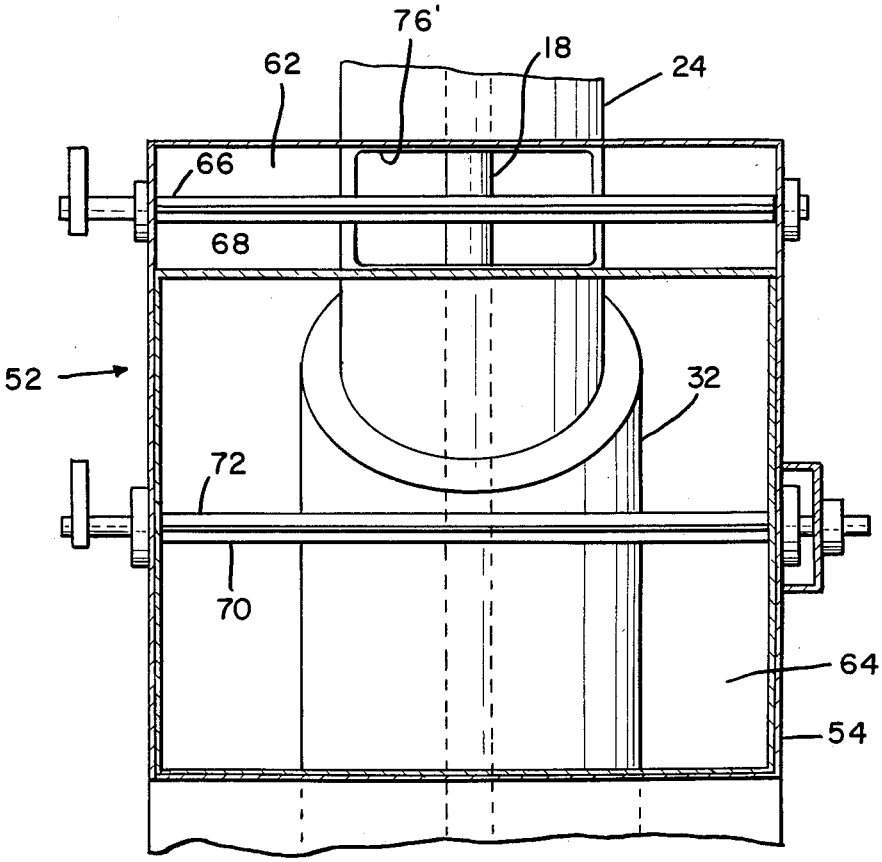
FIG. 4 is a sectional view taken along line 4—4 of FIG. 3.
Figure 3:
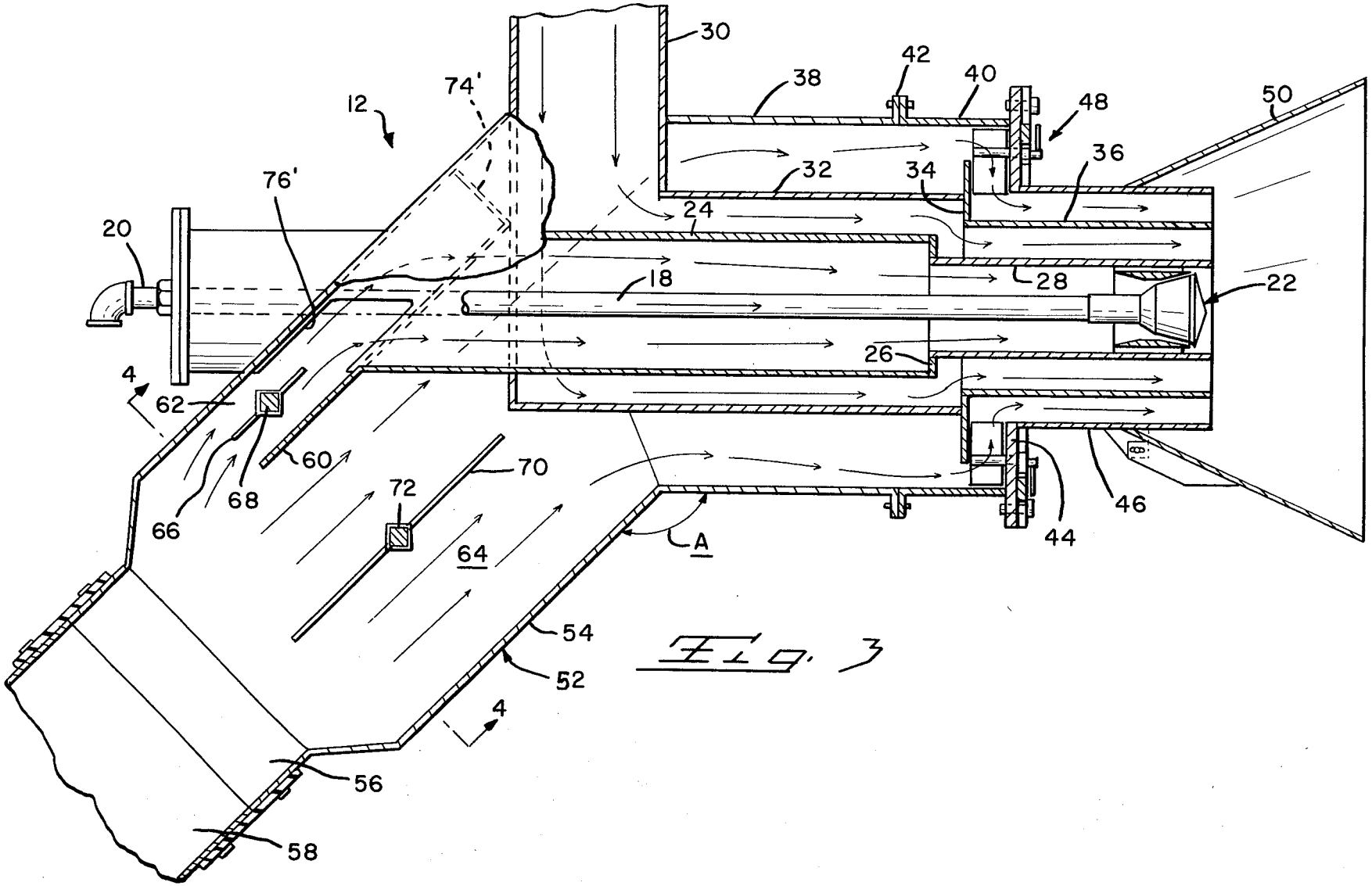
FIG. 3 is a vertical sectional view taken through the burner of FIG. 2.
Figure 5:
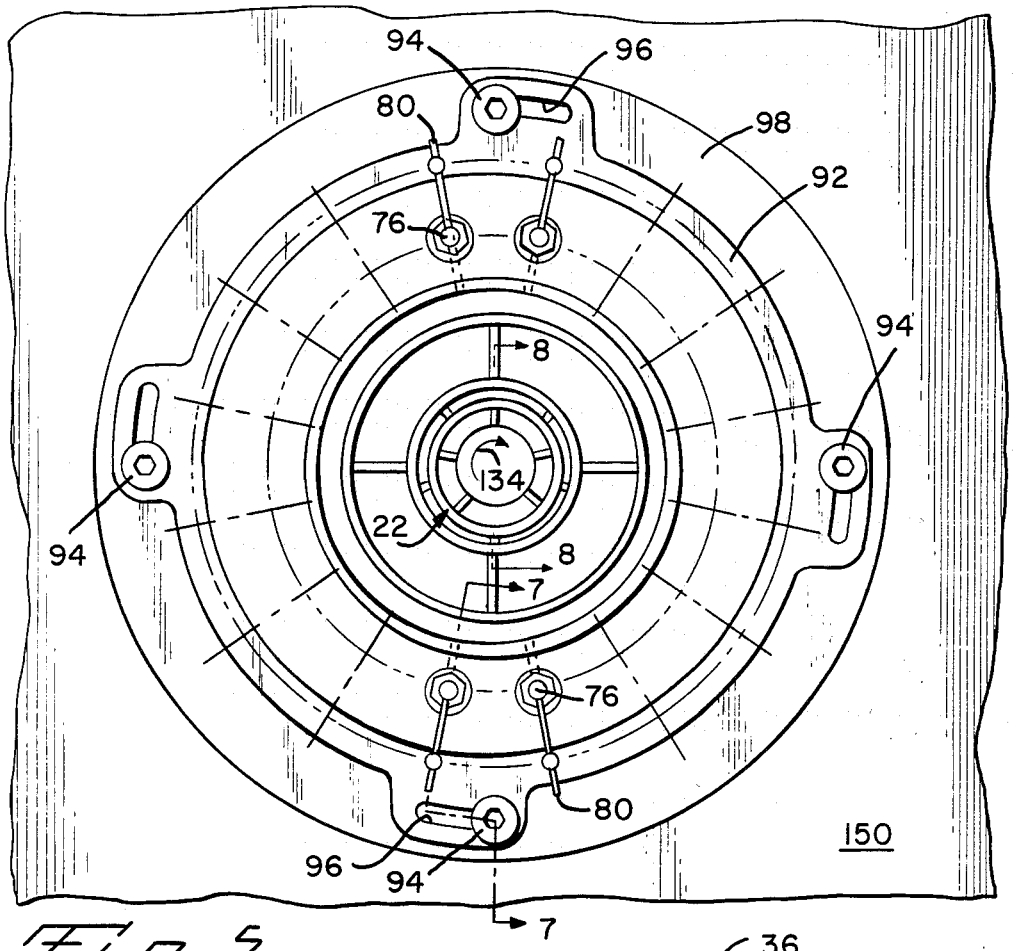

As illustrated in FIGS. 2 and 3, burner 12 includes an axial fuel oil pipe 18 leading from the upstream end 20 of the burner to atomizer assembly 22 located at the burner head at the downstream end of the burner. A cylindrical primary air pipe 24 surrounds oil pipe 18 and extends from the upstream end of the burner in a downstream direction to radially inward step 26. Primary air pipe 28 extends from the step to the burner head. The atomizer assembly 22 fitted within the downstream end of pipe 28. The assembly is recessed a short distance upstream from the end of pipe 28.

As gas inlet pipe 30 extends toward the burner axis and joins the upstream end of cylindrical gas pipe 32 surrounding primary air pipe 24. Pipe 32 extends downstream to radial inward step 34 and gas pipe 36 which extends from the step to the burner head. Square secondary air pipe 38 surrounding gas pipe 36 is connected at its downstream end to cylindrical secondary air pipe 40 by means of bolt-and-flange connection 42. A radially inward step 44 joins the downstream end of pipe 40 to the upstream end of secondary air pipe 46 which extends downstream to the burner head. An adjustable secondary air swirl vane assembly 48, shown in FIG. 2, is located at step 44. Frustro-conical flame holder 50 is mounted on the exterior of pipe 46 and surrounds the burner head. The flame holder may be adjusted axially with respect to the flame head to maximize flame stability and shape the flame. The inner end of the flame holder preferably forms a relatively air-tight seal with pipe 46.

Damper assembly 52 includes a square outer duct 54 having a cylindrical upstream end 56 connected to the outlet 58 of centrifugal blower 14. As shown in FIG. 3, the downstream end of duct 54 joins the upstream end of square duct 38 as an angle A of 135° to the burner axis. The damper assembly 52 includes an interior wall 60 dividing the interior of duct 54 into a primary air path 62 adjacent the top wall of duct 54 and a larger secondary air flow path 64 adjacent the bottom wall of duct 54. Rectangular primary air damper 66, carried by shaft 68, is located in passage 62. A larger rectangular secondary air damper 70, mounted on shaft 72, is located in the secondary air passage 64. The cross-sectional area of passage 64 is approximately four times larger than that of passage 62. Wall 60 extends between the sidewalls of duct 54 past the primary air pipe 24 to a closed end 74'. Primary air flows through passage 62, cutout 76' in the primary air pipe 24 and then downstream along the primary air pipes 24 and 28 to the atomizer assembly 22.

Secondary air flows through passage 64 and into secondary air pipes 38 and 40, past the spin-vane assembly 48 where swirl is imparted and then down pipe 46 to the burner head. When the burner is gas-fired, gas flows through inlet 40 and pipes 32 and 36 to the burner head. The dampers 66 and 70 may be adjusted as required to control the flow of primary and secondary air to the burner head.

Figure 6:
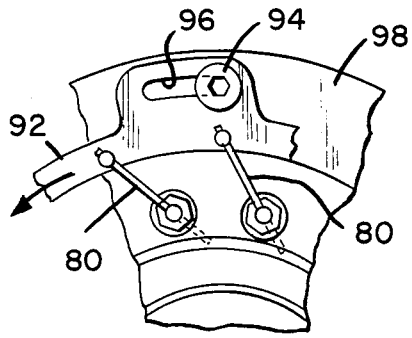
FIG. 6 is an enlarged view of a portion of FIG. 5.

The secondary air swirl vane assembly 48 is illustrated in further detail in FIGS. 5, 6 and 7. The assembly includes sixteen adjustable swirl vanes 74 spaced circumferentially around pipe 40, each secured to a shaft 76 rotatably mounted in a bore 78 extending through step 44. A pin 80 is fitted into the end of the shaft 76 projecting outwardly of step 44. Each vane 74 extends to both sides of a shaft 76 with a major part of the vane extending radially inwardly. The radial outward end 82 is adjacent the inner surface of pipe 40 and the radial inward end 84 is adjacent the inner surface of pipe 46. Step 34 extends radially inwardly from pipe 36 past pipe 32 and into the space between pipes 32 and 40, thereby defining an annular opening 86 immediately upstream of the swirl vane 74. The cross-sectional area of opening 86 is greater than the cross-sectional area of the secondary air flow path between pipes 36 and 46. As secondary air moves through opening 86, radially inwardly past the vanes 74 and into the passage between pipes 36 and 46, the cross-sectional flow area is progressively decreased, axial momentum of the air is in part converted to rotational momentum and axial and tangential velocity are increased. The relatively close fit between the vanes 74 and the interior walls of the secondary air path increases the efficiency in converting axial momentum to rotational momentum and thereby swirling the air as it flows toward the burner head. The major pressure drop in the secondary air occurs at the swirler where swirl is imparted and axial flow is accelerated.

Pins 80 lie above the planes of their respective vanes 74. The ends of the pins have a sliding fit through bores 88 extending through the exposed ends of cylindrical links 90. Links 90 are rotatably seated in bores 91 in ring 92. Annular adjustment ring 92 is rotatably fixed to the burner by a number of bolts 94 which extend through slots 96 in the ring and are screwed into exterior flanges 98 on the downstream end of pipe 40. Loosening of the bolts 94 permits limited rotation of ring 92 to rotate the links 90 and thereby rotate vanes 74 about shafts 76. Rotation of the ring 92 adjusts each vane so that it is on one side of a radial line extending through the axis of the shaft 76 and lies between 30° and 65° of the radial line to impart high swirl to the secondary air flowing through the spin vane assembly 48.

Atomizer assembly 22 is illustrated in FIGS. 8 and 9. The assembly includes oil atomizer 100 having a body 102 and cap 104. Threaded union 106 secures the upstream end 108 of body 102 to the threaded downstream end 110 of oil pipe 18. Threaded stud 112 secure the oil cap 104 flush on the end surface 114 of body 102. Surface 114 is perpendicular to the longitudinal axis of the burner.

Oil flowing through pipe 18 enters the nozzle through central bore 116 in body 102 and flows thereform through feeder bores 118 to an annular passage 120 extending to either side of surface 114. The oil cap 104 is recessed around the circumference of the oil nozzle outwardly of chamber 120 to define a 360° annular slit 122 having a width of approximately 0.024 inches.

A generally annular collar 124 is located within the downstream end of primary air pipe 28 and surrounds the atomizer 100 and the downstream end of union 106. The collar 124 is secured to union 106 by three spaced stabilizing struts 131. The collar is centrally located within pipe 28 to define a tubular outer primary air passage 126 between the inner cylindrical surface of pipe 28 and the outer cylindrical surface of the collar. As best illustrated in FIG. 9, five straight swirl vanes 128 are mounted on the outer surface of the collar at regular intervals around the circumference of the collar. These vanes extend at an angle B of 45° to the longitudinal axis of the burner. The length of the outer primary air vanes 128 is sufficient so that the downstream end of each vane circumferentially overlaps the upstream end of the adjacent vanes so that it is impossible for the outer primary air to pass through passage 126 without being swirled. The primary air passage 126 has a continuous cross-sectional area at the vanes.

The inner surface of the collar 124 and the outer surface of the atomizer 100 and union 106 define a generally annular inner primary air passage 130 having a decreasing cross-sectional area from the upstream end of the passage to the downstream end of the passage beyond atomizing slit 122. Body 102 carries five straight inner primary swirl vanes 132 spaced around the circumference of the body. These vanes are oriented at an angle C of 60° to the longitudinal axis of the burner. As illustrated in FIG. 9, the downstream end of each vane 132 angularly overlaps the upstream end of the adjacent vane 132 so that it is impossible for air to flow through passage 130 without being swirled. The outer primary swirl vanes 128 and the inner primary air swirl vanes 132 swirl primary air in the same direction around the longitudinal axis of the burner. Primary air is swirled in the direction of arrow 134 of FIG. 5. Secondary air is swirled in the same direction by the secondary air swirl vane assembly 48.

Primary air flowing through the passage 130 is accelerated by the decreased cross-sectional area of the passage and is highly swirled by the 60° vanes 132. The accelerated and highly swirling air passes the downstream ends of the vanes and flows out of the downstream mouth 134'. The mouth is directed radially outwardly from the axis at a shallow angle so that the highly swirling inner primary air is aimed at the swirling outer primary air flowing out of mouth 136 of outer passage 126. This enhances shear atomization. The pipe 28 extends downstream a short distance beyond mouths 134 and 136 to confine the outer primary air flow and assure shear atomization.

Fuel oil is delivered to atomizer 100 at a low pressure of one or two pounds per square inch and flows through slit 122 to form a thin 360° sheet of radially outwardly flowing fuel. This sheet is immediately entrained in the accelerated and highly spinning inner primary air and is carried with the inner primary air out of mouth 134'. The pressure head of the fuel oil is insufficient to inject the fuel into the inner primary air stream and wet or prefilm the inner surface of collar 124. The accelerated and swirling inner primary air breaks up the sheet into individual particles of fuel. Mixing of the inner and outer swirling streams, as described in further detail in connection with the operation of the burner 12, increases atomization and evaporization of the fuel for improved combustion efficiency.

The atomizer assembly 22 is confined within pipe 28 by the connection to axial oil pipe 18 with vanes 128 forming a close sliding fit with the interior surface of the pipe. In this way, the assembly may be easily removed from the pipe for servicing or replacement by unscrewing the connection between the downstream end of the oil pipe 18 and the upstream end of union 106.

Burner 12 includes a flame shield 150 surrounding the secondary air pipe 40 at bolt-and-flange connection 42. A spark-ignited gas pilot line 152 extends from the upstream end of the burner to ignite the burner flame. The upstream end of oil pipe 18 is attached to a fuel oil delivery system which forms part of a conventional control system for the burner. This system also controls the position of the dampers 66 and 70 and the valve of gas inlet line 30. The centrifugal blower 14 connected to the damper assembly 52 may be of the type disclosed in the U.S. Pat. Nos. 3,572,963 and 3,572,967 assigned to Hauck Manufacturing Co. of Lebanon, Pa. Other types of blowers or air sources may be used to supply combustion air to the burner.

Referring to FIG. 1, the portable asphalt dryer 10 includes a rotary drum 154 mounted on frame 16 with an elevated fixed burner end 156. The interior surface of the drum 154 includes a plurality of aggregate flights 158 so designed that aggregate supplied to the drum end 156 by conveyor 160 moves axially down the drum from end 156 to discharge end 161. Drum 154 typically is about 8 feet in diameter and about 30 feet long. During the travel of the aggregate down the drum for about the first 10 feet, the flights 158 hold the aggregate against the interior sidewalls of the drum to prevent aggregate from falling across the interior combustion zone. Bracket 162 indicates the portion of the drum where the flights hold the aggregate against the interior sides of the drum. The remaining portion of the flights away from end 156 permit the aggregate to fall across the interior of the drum as the drum rotates. The falling aggregate forms a curtain or veil of particulate material completely filling the interior of the drum. Bracket 164 indicates the portion of drum 154 in which the aggregate falls across the interior of the drum. The recirculating flame 170 occupies the space indicated by bracket 162 without contacting the aggregate veil.

Drum end 156 includes an interior opening 166 surrounding the end of burner flame holder 50. Typically, opening 166 has a diameter approximately one foot larger than the maximum diameter of the flame holder so that there is a 6-inch wide annular opening surround the flame holder. The dryer 10 includes a fan system (not illustrated) which draws air through opening 166 down the drum and out discharge opening 161. The frustro-conical shape of the flame holder serves to guide this air away from the burner head to prevent the flow from destabilizing the flame at low burn.

OPERATION OF THE BURNER

The interior recirculation flame of burner 12 is generally symmetrical in planes transverse to the burner axis and includes an annular recirculation zone 168 surrounding the burner axis as indicated diagrammatically in flame 170 of FIG. 1. Arrow 172 generally indicates the movement of the gas along the outside of the flame. The interior recirculation provided a swirler-type burner permits efficient combustion of heavy relatively nonvolatile fuel oils. These oils are recirculated in the burner sufficiently long so that the exposure to the high-temperature combustion gases heats the oil to the combustion temperature, thereby promoting complete burning of heavy oils.

The characteristics of swirl flames are discussed at Chapter 5, pp. 100–146 of Beer and Chigier, *Combustion Aerodynamics* (Halsted Press Division, John Wiley & Sons, Inc., 1972). This work defines a swirl number, S', for a swirling annular flow of gases and states swirling flows must have a swirl number greater than 0.6 to achieve internal recirculation.

The operation of the atomizer assembly 22 will now be described. During oil burns, primary air damper 66 is always open. The secondary air damper 70 is open at high burns and may be adjusted at intermediate positions at intermediate burns. At low burn, damper 70 is closed and compressor 14 supplies primary air only to the burner head.

At high burn, fuel is supplied to the atomizer assembly at a pressure of 1 to 2 pounds per square inch and flows radially outwardly of slit 122 in a continuous sheet. The flow of inner primary air moving through inner primary air passage 130 is accelerated and highly swirled by the 60° angle swirl vanes 132. This highly swirling and accelerated flow immediately entrains the outwardly flowing sheet of fuel oil, breaking up the sheet into small droplets and carrying the droplets with it outwardly of the downstream mouth 134 to prevent prefilming of the oil on the outer surface of the passage 130.

The rich fuel laden and highly swirling inner primary air stream has a calculated swirl number of about 1.55, well higher than the minimum value of 0.6 required to sustain swirled internal recirculation combustion. This highly swirling flow immediately shear mixes with the outer primary air flowing through the outer primary air passage 126. The outer primary air is swirled in the direction of arrow 134 by the 45° vanes 128 less violently than the inner primary air is swirled by the 60° vanes 132 so that the outer primary air exiting mouth 136 has a lower tangential or rotational velocity than the rotational velocity of the inner primary air. This difference in rotational velocity between the inner and outer primary air flows promotes violent intermixing between the flows, particularly within the end of the primary air pipe 28 downstream of mouths 134 and 136. The end of pipe 28 confines the outer primary air from radial expansion to promote the intermingling of the two flows. The interaction between the two flows causes accelerated shear atomization of the fuel particles entrained with the inner primary air, thereby reducing the size of the particles and, in a flame environment, heating the gas and entrained fuel.

The swirl number for the outer primary air flow is calculated to be approximately 0.96, a value considerably greater than the minimum value required for recirculation combustion but less than the value for the inner primary air-fuel mixture. The difference in values of the swirl numbers for the inner and outer primary air assures shear atomization and mixing of the fuel at the interface between the two flows. The two primary air flows join to form a single rotating and intermixing flow downstream of tube 28.

As the swirling, mixing inner and outer primary air flows leave the mouth of primary air pipe 28 they expand radially while moving axially downstream of the burner into the interior flame area 162 of the drum 154. The radial expansion decreases the pressure at the burner axis so that gases downstream of the burner are drawn axially upstream toward the burner to promote recirculation.

At low burn, the flame is considerably reduced over high-burn flame 170 shown diagrammatically in FIG. 1. The 25° frustro-conical flame holder 50 aids in shaping and holding the flame on the burner head while, at the same time, guiding tertiary air flowing into the drum through opening 166 away from direct contact with the flame. Such contact would tend to elongate, cool and destabilize the flame. This is particularly a problem in the case of certain types of aggregate dryers where the flow of tertiary air is not reduced when the burner is turned to a low heat.

At low burn, the amount of oil supplied to the atomizer assembly is much less than that supplied to the assembly at high burn. Th pressure of the low-burn oil in the atomizer assembly may be as little as 1 or 2 ounces per square inch, and may be insufficient to completely fill the annular chamber 120 and assure a 360° sheet of oil flows into the inner primary air. The inner and outer primary flows swirl sufficiently violently to assure retention of a stable low-burn flame on the burner head, despite possible asymmetrical fuel delivery from passage 130.

When the btu requirement for the dryer drum 154 is increased from a low-burn oil-fired mode, the pressure of the fuel delivered to the atomizer assembly is increased as the secondary air damper is opened, thereby increasing the volume of oil entrained in the primary air while initiating and increasing a flow of secondary air through the burner. The secondary air flows through the secondary air pipe 40 to the swirl vane assembly 48 and thence through secondary air pipe 46 to the burner head. The vanes of assembly 48 are adjusted to impart a high degree of swirl to the secondary air. For instance, when the vanes are adjusted to an angle of 30° to a radial line extending through the axis of vane pins 76, the secondary air swirl number is calculated to be 0.4. When the vanes are at an angle of 65° to the radial line, the swirl number is calculated to be 1.4. The major pressure drop in the secondary air occurs as the air passes the vanes, thereby effectively converting the pressure energy of the secondary air into an accelerated and highly swirling flow moving through pipe 46.

For a given burner, compressor 14 has a fixed pressure output of from 24 to 38 ounces per square inch. When a burner is set up, the angular orientation of the spin vanes 74 and the axial position of flame holder 50 are adjusted to tailor the shape of the flame to the particular application. Movement of the flame holder outwardly of the burner head increases the length of the flame while shortening its diameter. Adjustment of the spin vanes to impart greater angular momentum of the secondary air reduces the axial momentum of the secondary air and, as a result, foreshortens the flame while increasing its diameter. Conversely, adjustment of the spin vanes to reduce the swirl imparted to the secondary air lengthens the flame while reducing its diameter.

Swirling secondary air mixes with the radially expanding and more highly swirled primary air so that the flows actively intermingle and further promote fuel atomization. The secondary air surrounds the recirculating primary air and is itself recirculated axially upstream into the flame. This occurs even though the secondary air swirl number, taken alone, may be less than 0.6. Tertiary air mingles with the swirled primary and secondary flows and, at higher burns, is consumed in the flame.

Stable recirculation combustion has been achieved using relatively light No. 2 fuel oil with secondary air having a swirl number less than 0.6. It is necessary to increase the swirl number of the secondary air to provide stable recirculation combustion with heavier No. 5 or 6 fuel oil. The heavier oil does not burn as rapidily as light oil and must be recirculated and heated for a longer period of time for complete combustion.

Burner 12 may be fired by gas flowing through gas inlet 30 and outwardly of the burner head through pipe 36. At very low gas burn both dampers 66 and 70 are closed. Sufficient combustion air from compressor 14 flows past the closed dampers and through the burner 12 to impart a recirculating swirl to the gas, thereby assuring a stable recirculating gas flame on the burner head. This is because the swirl numbers for the primary and secondary air are determined by the burner geometry and are not a function of the pressure drop across the swirl generators. The swirl number is constant despite modulation of the primary and secondary air flows by dampers 66 and 70.

It is possible to maintain a minimum gas burn at a btu rating lower than the minimum btu rating at a low oil burn. The burner may be adjusted for a higher low gas burn with the primary air damper 66 partially open and with the gas inlet valve adjusted to supply gas in excess of the minimum gas flow required to sustain a flame.

With increased gas flow to the burner from the minimum flow, the secondary air damper 70 is opened, thereby supplying additional combustion air to maintain a stable recirculation flame. The swirl number for the secondary air may be less than 0.6 due to the ready combustibility of the gaseous fuel. In some circumstances, burner 12 may be fueled with a combination of oil or gas. Frequently this is the case where one fuel is less expensive than the other fuel, but limited in supply.

Burner 12 is continuously adjustable from low to high burns when fueled by gas or oil or a combination of gas and oil. At high burns, with both dampers 66 and 70 open, the burner supplies about 68 million btu per hour. When at high burn, the primary and secondary air flows provide about 35% to 40% of the air required for combustion and the tertiary air flow supplies about 65% to 60% of the air required for combustion. The secondary air flow is seven times larger than the primary air flow. The inner and outer primary air flows are approximately equal.

At low burn using a light fuel oil, such as No. 2, the burner produces about 7 million btu per hour on primary air alone. When heavy No. 5 or 6 fuel oil is used, the low burn setting has a higher btu output ranging approximately from 14 to 16 million btu per hour on primary air alone. This is because of the greater difficulty in burning the heavy, less volatile fuel.

The 135° obtuse-angle junction between the damper assembly 52 and the coaxial components of the burner provides a relatively smooth flow path for the slowly moving primary and secondary air as it passes the dampers, is bent 135° and enters the coaxial flow paths leading to the burner head. The primary air flows directly from blower 14 into passage 62 and then through a 135° obtuse angle into the primary air pipe 24. Secondary air likewise flows from the blower through passage 64 and through a 135° obtuse angle to the secondary air pipes 38 and 40. The main pressure drops for the primary and secondary air occur at the atomizing and swirl-vane assembly 22 and 48, downstream of the damper assembly and the angular junction between the damper assembly and the coaxial burner pipes. This construction provides for efficient low-pressure drop flow of the combustion air to the assemblies 22 and 48.

While we have illustrated and described the preferred embodiments of our invention, it is understood that these are capable of modification, and we therefore do not wish to be limited to the precise details set forth, but desire to avail ourselves of such changes and alterations as fall within the purview of the following claims.

What we claim our invention is:

1. A burner including an axial fuel pipe;

a fuel atomizer at the downstream end of the pipe;

a primary air pipe coaxial with the fuel pipe, surrounding the fuel pipe and extending upstream from the fuel atomizer;

a secondary air pipe coaxial with the fuel pipe, surrounding the primary air pipe and extending upstream from the atomizer;

said secondary air pipe having an exit portion extending parallel to the axis of said fuel pipe;

means for swirling primary air in a first direction; said means for swirling primary air including means adjacent said fuel atomizer defining two separate concentric swirl passages dividing the primary air into two flow masses, the first of said primary swirl passages configured to accelerate the flow of a first primary air mass therethrough in a swirling motion, the second of said primary swirl passages configured to impart a slower swirling motion to a second primary air mass flowing therethrough such that said second air mass flows faster axially than said first air massto thereby provide strong sheer atomization of fuel near said fuel atomizer upon engagement of the respective swirling air masses;

the inner one of said separate concentric primary swirl passages having an exit portion diverging away from said atomizer and the outer of said primary swirl passages having an exit portion extending parallel to the axis of said fuel pipe;

means for swirling secondary air in said first direction, said secondary air swirling means being adjustable to provide a varying degree of swirl in said secondary air; and a damper assembly joining the primary and secondary air pipes including an outer duct connected to said primary and secondary air pipes at an angle such that primary and secondary air respectively are directed with a minimum pressure drop to each respective primary and secondary swirling means, the duct having an upstream mouth adapted to be connected to a souce of combustion air, an interior wall dividing the duct into a primary air passage and a secondary air passage, both passages communicating with the upstream duct mouth, the primary air passage communicating with the primary air pipe, the secondary air passage communicating with the secondary air pipe, a first damper within the primary air passage to control the flow of primary air therethrough, a second damper within the secondary air passage to control the flow of secondary air therethrough.

2. A burner as in claim 1 wherein the primary air pipe includes a larger diameter upstream section, a smaller diameter downstream section and a radially inward step joining said sections a distance upstream from the atomizer; and the secondary air pipe includes a larger diameter section, a smaller diameter section and a radially inward step joining said sections located downstream of the step in the primary air pipe.

3. A burner as in claim 2 including a gas pipe coaxial with the fuel pipe located between the primary and secondary air pipes, as inlet means joining the upstream end of the gas pipe and extending outwardly of the burner away from the damper assembly, said gas pipe including a radially inwardly extending step located between the radially inwardly extending steps in said primary and secondary air pipes.

4. A burner as in claim 2 including a plurality of secondary air swirl vanes located in the space between the steps in the primary and secondary air pipes and a gang ring operatively connected to said secondary air swirl vanes whereby movement of said ring simultaneously moves the vanes to vary the degree of swirl imparted to secondary air.

5. A burner as in claim 1 wherein said duct is rectangular in cross section, said interior wall extends between opposite sides of the duct to define rectangular primary and secondary air passages and the primary air passage is located on the side of the duct nearest said fuel pipe axis.

6. A burner as in claim 5 wherein the side of the duct farthest from said fuel pipe axis is oriented at approximately 135° to said axis and the side of the duct nearest said axis is oriented at an angle of approximately 45° to said axis.

7. A burner as in claim 1 including a frusto-conical flame holder and air deflector mounted on said secondary air pipe adjacent the downstream end thereof and extending downstream beyond the burner head, said flame holder and air deflector having a close fit with the secondary air pipe to limit the flow of air therebetween.

8. A burner as in claim 7 wherein the flame holder is axially adjustable and extends outwardly at an angle of approximately 25°.

9. A burner as in claim 1 wherein the angular change in direction of primary air flow between said primary air passage of said primary air pipe is not more than 45°.

10. A burner as in claim 9 wherein the angular change in direction of secondary air flow between said secondary air passage and said secondary air pipe is not more than 45°.

11. A swirl type burner comprising an axial atomizer having first swirl generating means for swirling an inner flow of primary air in a first direction, an oil delivery passage opening into the swirled first flow of air, second swirl generating means located outwardly and surrounding the first swirl generating means for swirling a second flow of primary air in said first direction, the downstream mouths of said first and second means being located adjacent to each other so that the swirled first and second flows are free to intermingle following discharge from the mouths to thereby provide strong sheer atomization of fuel near said atomizer;

the mouth of said first swirl generating means having a portion diverging away from said atomizer and the mouth of said second swirl generating means having a portion extending parallel to the axis of said atomizer;

outer swirl generating means surrounding said atomizer for swirling in said first direction a third flow of air comprising secondary air;

said outer swirl generating means having a exit portion extending parallel to the axis of said atomizer;

means for directing combustion air with a minimum loss in pressure to each of the first and second swirl generating means and to the outer swirl generating means;

a gas delivery system including a gas pipe having an annular gas outlet located between the atomizer and the outer swirl generating means so that said system delivers gas between the swirling inner flows of primary air and the outer flow of secondary air, each of said atomizer, outer swirl generating means and gas delivery system having downstream ends defining a burner head; and a frustro-conical member surrounding the burner head and secured to the outer swirl generating means, said frusto-conical member including an outer air deflector surface extending from the outer swirl generating means a distance radially outwardly and axially downstream past the burner head for deflecting downstream flowing air from the burner heed and an inner surface for shaping the flame on the burner head.

12. A burner as in claim 11 where the swirl number for the first swirl generating means is about 1.55, the swirl number for the second swirl generating means is about 0.96 and the swirl number for the outer swirl generating means is apprximately between 0.4 and 1.4 and the burner flame is of the internal recirculation type.

13. A burner as in claim 12 wherein the outer swirl generating means includes a set of adjustable radial swirl vanes and means ganging said vanes together for simultaneous movement to vary the swirl number of the outer swirl generating means.

14. A burner as in claim 13 including dampers controlling the flow of air to each of said swirl generating means, said dampers have opened and closed positions, said closed positions permitting sufficient air flow to the swirl means to maintain an internal recirculation gas flame at low burn.

15. A burner including an axial fuel pipe;

a fuel atomizer at the downstream end of said fuel pipe;

a primary air pipe coaxial with and surrounding said fuel pipe and extending upstream from said atomizer;

a secondary air pipe coaxial with said fuel pipe, surrounding said primary air pipe and extending upstream from said atomizer;

means adjacent to said atomizer for swirling primary air including means defining a first swirl passage and a second swirl passage, said first and second swirl passages being oriented concentrically relative to each other, each of said first and second swirl passages being configured to accelerate the primary air flowing respectively therethrough in a swirling motion in the same direction and at a different degree of swirl and in an axial direction at a different flow rate than the other said swirl passage, thereby to promote strong sheet atomization of fuel near said atomizer;

the inner one of said primary swirl passages having an exit portion diverging away from said atomizer and the outer of said primary swirl passages having an exit portion extending parallel to the axis of said fuel pipe;

means for swirling secondary air in the same direction as the swirling primary air flows, said secondary air swirling means being adjustable to provide a varying degree of swirl in said secondary air;

said secondary airpipe having an exit portion extending parallel to the axis of said fuel pipe; and means for directing combustion air with a minimum loss in pressure to the respective primary and secondary swirling means.

16. A swirl type burner as in claim 15, wherein said secondary pipe includes an annular first diameter passage extending to the burner head, an annular second flow passage having a diameter larger than said first passage and extending upstream from the upstream end of the first passage; a radially inward stop joining the downstream end of the annular second flow passage with the upstream end of the annular first diameter passage, said step including an outer annular wall joining the outer walls of said passages and an inner annular wall joining the inner walls of said passages; and a swirl vane assembly at said step including a plurality of radial vanes positioned between said walls, each vane including a shaft rotatably extending through a bore in the outer step wall, said shafts being arranged in a circle on said wall, a pin extending from the outer end of each shaft, an annular adjustment ring surface thereof adjacent to each shaft, a link rotatably seated in each bore, each link having a cross bore with the pin from the adjacent shaft slideably extending through said cross bore, and adjustment ring lock means for freeing said annular adjustment ring for limited rotational movement to move all of said links relative to said shafts and thereby simultaneously rotate said radial vanes to vary the swirl of the flow and for locking the ring and vanes in a desired position.

17. A burner as in claim 16 wherein said inner wall includes an outwardly extending annular portion cooperating with said outer wall to define a radially inward flow path at the step, said vanes being positioned within said radially inward flow path.

18. A burner as in claim 16 wherein each of said vanes includes a portion extending from the shaft radially inwardly to substantially fill the space between said walls and a portion extending radially outwardly of the shaft to substantially fill the space therefrom to the outer wall of the second flow passage.

19. A burner as in claim 18 wherein said vanes are adjustable between 30° and 65° to a radial line extending from the axis of the individual pins to the burner axis.

20. A burner as in claim 16 wherein the swirl number for the assembly is between about 0.4 and 1.4.

* * * * *

UNITED STATES PATENT AND TRADEMARK OFFICE

CERTIFICATE OF CORRECTION

PATENT NO. : 4,559,009

DATED : December 17, 1985

INVENTOR(S) : MARINO ET AL.

It is certified that error appears in the above-identified patent and that said Letters Patent is hereby corrected as shown below:

Column 10, line 34, change "massto" to --mass to--;

Column 11, line 31, change "frusto-conical" to --frustro-conical--;

Column 12, line 15, change "frusto-conical" to --frustro-conical--; and

Column 12, line 60, change "sheet" to -sheer--.

Signed and Sealed this

*Twenty-fifth* Day of *February 1986*

[SEAL]

*Attest:*

DONALD J. QUIGG

*Attesting Officer*

*Commissioner of Patents and Trademarks*